US010245595B2

(12) United States Patent
Reyes et al.

(10) Patent No.: US 10,245,595 B2
(45) Date of Patent: Apr. 2, 2019

(54) CONTROLLING A HIGH VOLTAGE POWER SUPPLY FOR AN ELECTROSTATIC PRECIPITATOR

(71) Applicant: FLSmidth A/S, Valby (DK)

(72) Inventors: Victor Enrique Reyes, Søborg (DK); Michael Roland Hansen, Søborg (DK)

(73) Assignee: FLSmidth A/S (DK)

( * ) Notice: Subject to any disclaimer, the term of this patent is extended or adjusted under 35 U.S.C. 154(b) by 276 days.

(21) Appl. No.: 15/318,647

(22) PCT Filed: Jun. 11, 2015

(86) PCT No.: PCT/DK2015/050161

§ 371 (c)(1),
(2) Date: Dec. 13, 2016

(87) PCT Pub. No.: WO2015/188837

PCT Pub. Date: Dec. 17, 2015

(65) Prior Publication Data

US 2017/0157623 A1 Jun. 8, 2017

(30) Foreign Application Priority Data

Jun. 13, 2014 (DK) ..... 2014 70352

(51) Int. Cl.
*B03C 3/68* (2006.01)

(52) U.S. Cl.
CPC ..... *B03C 3/68* (2013.01)

(58) Field of Classification Search
CPC ..... B03C 3/68
See application file for complete search history.

(56) References Cited

U.S. PATENT DOCUMENTS 3,504,480 A * 4/1970 Copcutt ..... B03C 3/00 124/3
3,772,853 A * 11/1973 Burge ..... B03C 3/66 323/246

(Continued)

OTHER PUBLICATIONS

Ken Parker, Chapter 6: Modern mains frequency energistation and control, Electriical operation of electrostatic precipitators119-146, ISBN:978-0-85296-137-7, Institution of Electrical Engineers, London/Great Britain.

(Continued)

*Primary Examiner* — Duane Smith
*Assistant Examiner* — Sonji Turner
(74) *Attorney, Agent, or Firm* — Jeffrey A. Sharp

(57) ABSTRACT

A high voltage power supply for an electrostatic precipitator comprises a high voltage transformer, a high voltage bridge rectifier and a semiconductor switch controller configured to control an output power level of the high voltage power supply. A control unit (50) is configured to determine a firing angle of firing pulses for the semiconductor switch controller. During normal operation, a peak voltage value is measured and stored in each half period. When a breakdown is detected, a residual voltage ($U_r$) over the electrostatic precipitator is measured. A firing angle ($\alpha_1$) of a firing pulse to be provided to said semiconductor switch controller in the first half period after the breakdown is determined from the latest stored measured peak voltage value ($U_{bef}$) and the measured residual voltage ($U_r$) based on a predetermined relationship between the firing angle ($\alpha_1$) and said measured voltages.

15 Claims, 8 Drawing Sheets

(56) References Cited

U.S. PATENT DOCUMENTS 3,984,215 A * 10/1976 Zucker ..... B03C 3/68 95/81
4,138,232 A * 2/1979 Winkler ..... B03C 3/68 327/91
4,209,306 A * 6/1980 Feldman ..... B03C 3/38 95/80
4,238,810 A * 12/1980 Stevenson ..... B03C 3/68 361/235
4,282,014 A * 8/1981 Winkler ..... B03C 3/68 327/58
4,390,830 A * 6/1983 Laugesen ..... B03C 3/68 323/237
4,433,281 A * 2/1984 Herklotz ..... B03C 3/68 323/246
4,445,911 A * 5/1984 Lind ..... B03C 3/66 323/903
4,536,698 A * 8/1985 Shevalenko ..... B03C 3/68 323/237
4,558,404 A * 12/1985 James ..... B03C 3/68 315/209 CD
4,644,439 A * 2/1987 Taarning ..... B03C 3/68 323/903
4,659,342 A * 4/1987 Lind ..... B03C 3/66 323/903
4,665,476 A * 5/1987 Masuda ..... B03C 3/68 323/903
4,670,829 A * 6/1987 Dallhammer ..... B03C 3/68 307/2
4,698,719 A * 10/1987 Taarning ..... B03C 3/68 361/100
4,746,331 A * 5/1988 Truce ..... B03C 3/68 95/2
4,808,200 A * 2/1989 Dallhammer ..... B03C 3/68 307/2
4,854,948 A * 8/1989 Eiserlo ..... B03C 3/68 96/20
4,873,620 A * 10/1989 Neulinger ..... B03C 3/68 363/57
4,909,812 A * 3/1990 Shapenko ..... B03C 3/68 323/903
5,378,978 A * 1/1995 Gallo ..... B03C 3/68 323/241
5,477,464 A * 12/1995 Jacobsson ..... B03C 3/68 323/903
5,639,294 A * 6/1997 Ranstad ..... B03C 3/68 323/903
5,689,177 A * 11/1997 Nielsen ..... G06F 1/26 323/241
5,707,422 A * 1/1998 Jacobsson ..... B03C 3/013 95/58
7,081,152 B2 * 7/2006 Altman ..... B03C 3/68 323/903
7,547,353 B2 * 6/2009 Reyes ..... B03C 3/68 323/247
8,000,102 B2 * 8/2011 Johnston ..... B03C 3/68 336/65
8,007,566 B2 * 8/2011 Abdelkrim ..... B03C 3/08 95/5
2004/0004797 A1 * 1/2004 Krichtafovitch ..... B03C 3/68 361/91.1
2005/0178265 A1 * 8/2005 Altman ..... B03C 3/68 95/2
2006/0055343 A1 * 3/2006 Krichtafovitch ..... B03C 3/68 315/291
2008/0190295 A1 * 8/2008 Reyes ..... B03C 3/68 96/82

OTHER PUBLICATIONS

Prof. Dr.-Ing. Norbert Grass, Electrostatic precipitator diagnostics based on flashover characteristics, Conference record of the 2005 IEEE Industry Applications Conference, Oct. 2, 2005, 2573-2577, 4, IAS, Hong Kong, China.

International Search Report and Written Opinion dated Aug. 31, 2015, 10 pages.

* cited by examiner

CONTROLLING A HIGH VOLTAGE POWER SUPPLY FOR AN ELECTROSTATIC PRECIPITATOR

TECHNICAL FIELD

The invention relates to a method of controlling a high voltage power supply for an electrostatic precipitator, and also to a high voltage power supply for an electrostatic precipitator and to an electrostatic precipitator apparatus comprising an electrostatic precipitator and a high voltage power supply.

BACKGROUND

High voltage power supplies are, among other things, used for high voltage energization of electrostatic precipitators. An electrostatic precipitator is used e.g. in filtering particulate in exhausting gases from industrial processes. Often electrostatic precipitators comprise a number of fields in series in the gas direction. Because the dust concentration decreases along the electrostatic precipitator, i.e. the dust concentration at the inlet of each field is different, each of them typically has its own high voltage power supply.

The main unit in such high voltage power supply is a so-called transformer-rectifier set (TR set) comprising a high voltage transformer and a high voltage bridge rectifier. Transformer-rectifier sets can be single-phase or three-phase depending on the particular application of the electrostatic precipitator, and they are often immersed in a transformer oil filled tank.

The power delivered by the transformer-rectifier set to the electrostatic precipitator may be regulated by controlling its primary side by a semiconductor switch controller, e.g. a thyristor controller, that may be mounted inside a control cabinet. The thyristor controller comprises a pair of thyristors connected in antiparallel and is sometimes also called an AC line regulator. Alternatively, a semiconductor switch controller utilizing other types of controllable semiconductor switches may be used. This controller uses the principle of phase control for varying continuously the power delivered to a load. Phase control means that the firing angle (i.e. the phase angle at which e.g. a thyristor is fired or triggered in a given half period of the line frequency) of the individual switching elements, e.g. the thyristors, may be delayed/increased (i.e. fired later) for decreasing the power delivered to the load or it may be advanced/decreased (i.e. fired earlier) for increasing the power delivered to the load. The controller and the transformer-rectifier set may be protected by a circuit breaker and may be connected and disconnected by means of a main contactor.

The firing angle is normally determined in an automatic control unit that may be microprocessor-based and then transmitted to firing circuitry, where the firing command is converted into two firing pulses 180° apart having the correct width, which are then applied to the gate of each thyristor or other type of switching element.

In order to get the best efficiency of the electrostatic precipitator, the voltage applied to each electrostatic precipitator field should be as high as possible. The limiting factor here is the breakdown of the gas treated by the electrostatic precipitator in the form of sparks or arcs that may occur at high voltages. The difference between sparks and arcs is the duration of the breakdown. A spark is very short, while the electrostatic precipitator voltage in case of an arc remains low as long as the surge current is present, which may be for several half periods of the line frequency.

After a breakdown, the electrostatic precipitator voltage must be recovered by firing the switching controller again in order to ensure an efficient capture of particulate. Thus after the surge current has elapsed, a firing angle for the switching element has to be determined, so that the electrostatic precipitator voltage can be recovered as fast as possible. However, if a high voltage level is attained too fast, it may cause multiple sparking, i.e. new sparks may occur in the recovery period, which is detrimental for the efficiency of the electrostatic precipitator. On the other hand, a too slow recovery is also detrimental for the efficiency of the electrostatic precipitator.

The sparking level depends mainly on the gas composition, temperature and humidity, and the dust concentration as well. Thus the sparking level is not constant, and therefore, a quite common procedure is to reduce the voltage level after a breakdown by selecting a later firing angle than before the breakdown and then advancing the firing angle gradually for increasing the electrostatic precipitator voltage until a new spark occurs. This means that the transformer-rectifier set is operated at a certain spark rate, commonly in the range 10-60 sparks/min.

Examples of systems using this solution are known e.g. from U.S. Pat. Nos. 4,860,149 and 5,689,177. In U.S. Pat. No. 4,860,149, the power is, to avoid the risk of multiple sparking, immediately after the spark reduced to zero where it remains for a period of time (blocking period) of up to 50 ms. The power or the voltage is then increased along a relatively fast ramp from zero to a setback level (at a certain percentage below the level before the breakdown) over a time period that may also last several half periods of the line frequency. The power or the voltage is then gradually increased along a slow ramp until a new breakdown occurs. This solution very well reduces the risk of multiple sparking, but the blocking period and the ramping up of the voltage from zero results in a slow recovery of the electrostatic precipitator voltage, which is detrimental to the efficiency of the electrostatic precipitator. Further, all control actions are based on the primary current and the output current delivered to the electrostatic precipitator, which impairs the voltage recovery considerably.

In U.S. Pat. No. 5,689,177, the frequency of breakdowns, i.e. the spark rate, is minimized by first quenching the breakdown in N half periods and then controlling the firing angle by means of three ramps whose slope is determined by statistical calculation based on data, where previous firing angles seem to be the most important parameter. It is noted that in this document the term "firing angle" is used in the meaning "conduction angle", which is in contrast to the present application. This method has a shortcoming as the control process is initiated by introducing a quench or blocking interval of N half periods, where the output power delivered to the electrostatic precipitator is zero. Together with the ramping up of the voltage from zero, it results in a slow recovery of the electrostatic precipitator voltage, which is detrimental to the collecting efficiency of the electrostatic precipitator. Alone the presence of the blocking period can cause a decrease in the average voltage applied to the electrostatic precipitator field of as much as 5-6 kV.

SUMMARY

Therefore, it is an object of embodiments of the invention to provide a method of controlling a high voltage power supply that allows a faster voltage recovery after a breakdown without increasing the risk of multiple sparking, and which thus improves the cleaning efficiency of an electrostatic precipitator.

According to embodiments of the invention the object is achieved in a method of controlling a high voltage power supply for an electrostatic precipitator, said high voltage power supply comprising a transformer-rectifier set comprising a high voltage transformer, a primary side of which is connectable to an AC industrial mains net having a line frequency, and a high voltage bridge rectifier connected to a secondary side of said high voltage transformer and configured to supply a rectified high voltage to said electrostatic precipitator; a semiconductor switch controller arranged at the primary side of said high voltage transformer and configured to control an output power level of the high voltage power supply; firing circuitry configured to provide firing pulses to said semiconductor switch controller; and a control unit configured to determine a firing angle of said firing pulses and to control said firing circuitry accordingly. The object is achieved when the method comprises the steps of measuring during normal operation of said electrostatic precipitator a peak voltage value over said electrostatic precipitator in each half period of said line frequency; storing said measured peak voltage value; detecting the occurrence of an electrical breakdown in said electrostatic precipitator; measuring, when a breakdown is detected, a residual voltage over the electrostatic precipitator; determining a firing angle of a firing pulse to be provided to said semiconductor switch controller in the first half period after the occurrence of said breakdown, wherein said firing angle is determined from the latest stored measured peak voltage value and the measured residual voltage based on a predetermined relationship between said firing angle and the latest stored measured peak voltage value and the measured residual voltage; and providing a firing pulse with the determined firing angle to said semiconductor switch controller.

When the peak voltage just before a breakdown and the residual voltage just after the breakdown are measured, and a new firing angle is determined from these measured values and a predetermined relationship between them and an appropriate firing angle, an improved voltage recovery of the electrostatic precipitator can be achieved. Providing a new firing pulse to the semiconductor switch controller already in the first half period after the occurrence of a breakdown ensures that unnecessary quench intervals are avoided. The voltage after the breakdown is recovered as soon as possible without introducing a quench interval or ramping up the voltage. The sparking rate is automatically kept at an acceptable level. The firing angle to be used after a breakdown is calculated based on the peak voltage before the spark and considering the residual voltage measured just after the breakdown.

In some embodiments, the method further comprises the step of determining said predetermined relationship with said firing angle and the latest stored measured peak voltage value and the measured residual voltage by performing computer simulations on a model of said electrostatic precipitator and said transformer-rectifier set. This allows a relatively precise determination of the relationship. Alternatively, the predetermined relationship may be determined based on measurements performed on the components of the power supply and the electrostatic precipitator.

The method may further comprise the step of approximating said predetermined relationship by a set of linear functions, wherein each linear function defines an approximated relationship between an aimed peak voltage value and said firing angle for a value of measured residual voltage. Such approximation simplifies the determination of the desired firing angle.

The method may further comprise the step of providing a mathematical expression representing each of said linear functions, so that said firing angle can be calculated from the latest stored measured peak voltage value and the measured residual voltage using said mathematical expression. This allows the firing angle to be calculated by a calculation unit.

In such case, the method may further comprise the step of calculating said firing angle on-line from the latest stored measured peak voltage value and the measured residual voltage using said mathematical expression when a breakdown has been detected.

Alternatively, the method may further comprise the steps of pre-calculating said firing angle for different values of the peak voltage before the breakdown and the residual voltage using said mathematical expression; storing the pre-calculated firing angle values together with corresponding values of the peak voltage before the breakdown and the residual voltage in a look-up table; and reading, when a breakdown has been detected, a pre-calculated firing angle value corresponding to the latest stored measured peak voltage value and the measured residual voltage from said look-up table.

In some embodiments, the method may further comprise the steps of using under normal operation of said electrostatic precipitator a closed-loop control of a mean output current from the power supply to determine a value of the firing angle to be used in each half period of the line frequency; opening, when a breakdown is detected, said closed-loop control; determining a firing angle from the latest stored measured peak voltage value and the measured residual voltage; and providing a first firing pulse with the determined firing angle to said semiconductor switch controller.

In this case, the method may further comprise the step of reverting to the closed-loop control of the mean output current from the power supply to determine the value of the firing angle to be used in each half period of the line frequency when the semiconductor switch controller has been fired with said first firing pulse.

Alternatively, the method may further comprise the steps of determining, when the semiconductor switch controller has been fired with said first firing pulse, a further firing angle from the latest stored measured peak voltage value and a residual voltage measured after said first firing pulse; providing a second firing pulse with the determined further firing angle to said semiconductor switch controller; and reverting to the closed-loop control of the mean output current from the power supply to determine the value of the firing angle to be used in each half period of the line frequency when the semiconductor switch controller has been fired with said second firing pulse.

In some embodiments, the method may further comprise the steps of determining by measuring an output voltage of the power supply whether the detected break-down is a spark or an arc; inserting, if the detected breakdown is an arc, a blocking period of a few half-periods, where the semiconductor switch controller is not fired; determining after said blocking period a firing angle of a firing pulse to be provided to said semiconductor switch controller in the first half period after the occurrence of the arc, wherein said firing angle is determined from the latest stored measured peak voltage value and a residual voltage measured during said blocking period; and providing a firing pulse with the determined firing angle to said semiconductor switch controller. In this way, it is ensured that a blocking period is only inserted in case of arcing, thus allowing a much faster voltage recovery in case of sparks.

As mentioned, the invention also relates to a high voltage power supply for an electrostatic precipitator, said high voltage power supply comprising a transformer-rectifier set comprising a high voltage transformer, a primary side of which is connectable to an AC industrial mains net having a line frequency, and a high voltage bridge rectifier connected to a secondary side of said high voltage transformer and configured to supply a rectified high voltage to said electrostatic precipitator; a semiconductor switch controller arranged at the primary side of said high voltage transformer and configured to control an output power level of the high voltage power supply; firing circuitry configured to provide firing pulses to said semiconductor switch controller; and a control unit configured to determine a firing angle of said firing pulses and to control said firing circuitry accordingly. The control unit comprises a breakdown detector configured to detect the occurrence of an electrical breakdown in said electrostatic precipitator; an interface circuit configured to measure, during normal operation of said electrostatic precipitator, a peak voltage value over said electrostatic precipitator in each half period of said line frequency and to measure, when a breakdown is detected, a residual voltage over the electrostatic precipitator; a memory configured to store said measured peak voltage value; and a calculation unit configured to determine a firing angle of a firing pulse to be provided to said semiconductor switch controller in the first half period after the occurrence of a breakdown, wherein the calculation unit is further configured to determine said firing angle from the latest stored measured peak voltage value and the measured residual voltage based on a predetermined relationship with said firing angle and the latest stored measured peak voltage value and the measured residual voltage.

When the peak voltage just before a breakdown and the residual voltage just after the breakdown are measured, and a new firing angle is determined from these measured values and a predetermined relationship between them and an appropriate firing angle, an improved voltage recovery of the electrostatic precipitator can be achieved. Providing a new firing pulse to the semiconductor switch controller already in the first half period after the occurrence of a breakdown ensures that unnecessary quench intervals are avoided. The voltage after the breakdown is recovered as soon as possible without introducing a quench interval or ramping up the voltage. The sparking rate is automatically kept at an acceptable level. The firing angle to be used after a breakdown is calculated based on the peak voltage before the spark and considering the residual voltage measured just after the breakdown.

In some embodiments, the predetermined relationship with said firing angle and the latest stored measured peak voltage value and the measured residual voltage has been determined by computer simulations on a model of said electrostatic precipitator and said transformer-rectifier set. This allows a satisfactory determination of the relationship. Alternatively, the predetermined relationship may be determined based on measurements performed on the components of the power supply and the electrostatic precipitator.

The predetermined relationship may have been approximated by a set of linear functions, wherein each linear function defines an approximated relationship between an aimed peak voltage value and said firing angle for a value of measured residual voltage. Such approximation simplifies the determination of the desired firing angle.

The calculation unit may be configured to calculate said firing angle from the latest stored measured peak voltage value and the measured residual voltage using a mathematical expression representing each of said linear functions.

In such case, the calculation unit may be configured to calculate said firing angle on-line from the latest stored measured peak voltage value and the measured residual voltage using said mathematical expression when a breakdown has been detected.

Alternatively, the control unit may further comprise a look-up table having stored therein firing angle values pre-calculated for different values of the peak voltage before the breakdown and the residual voltage using said mathematical expression; and the calculation unit is configured to read, when a breakdown has been detected, a pre-calculated firing angle value corresponding to the latest stored measured peak voltage value and the measured residual voltage from said look-up table.

In some embodiments, the control unit is further configured to use under normal operation of said electrostatic precipitator a closed-loop control of a mean output current from the power supply to determine a value of the firing angle to be used in each half period of the line frequency; open, when a breakdown is detected, said closed-loop control via a switch; determine in the calculation unit a firing angle from the latest stored measured peak voltage value and the measured residual voltage; and provide via said switch a first firing pulse with the determined firing angle to said semiconductor switch controller.

In this case, the control unit may further be configured to revert to the closed-loop control of the mean output current from the power supply to determine the value of the firing angle to be used in each half period of the line frequency when the semiconductor switch controller has been fired with said first firing pulse.

Alternatively, the control unit may further be configured to determine, when the semiconductor switch controller has been fired with said first firing pulse, a further firing angle from the latest stored measured peak voltage value and a residual voltage measured after said first firing pulse; provide a second firing pulse with the determined further firing angle to said semiconductor switch controller; and revert to the closed-loop control of the mean output current from the power supply to determine the value of the firing angle to be used in each half period of the line frequency when the semiconductor switch controller has been fired with said second firing pulse.

In some embodiments, the control unit may further be configured to determine by measuring an output voltage of the power supply whether the detected break-down is a spark or an arc; insert, if the detected breakdown is an arc, a blocking period of a few half-periods, where the semiconductor switch controller is not fired; determine after said blocking period a firing angle of a firing pulse to be provided to said semiconductor switch controller in the first half period after the occurrence of the arc, wherein said firing angle is determined from the latest stored measured peak voltage value and a residual voltage measured during said blocking period; and provide a firing pulse with the determined firing angle to said semiconductor switch controller. In this way, it is ensured that a blocking period is only inserted in case of arcing, thus allowing a much faster voltage recovery in case of sparks.

In some embodiments, the semiconductor switch controller is a thyristor controller comprising a set of antiparallel coupled thyristors.

An electrostatic precipitator apparatus may comprise an electrostatic precipitator and a high voltage power supply as described above.

BRIEF DESCRIPTION OF THE DRAWINGS

Embodiments of the invention will now be described more fully below with reference to the drawings, in which.

DETAILED DESCRIPTION

Figure 1:
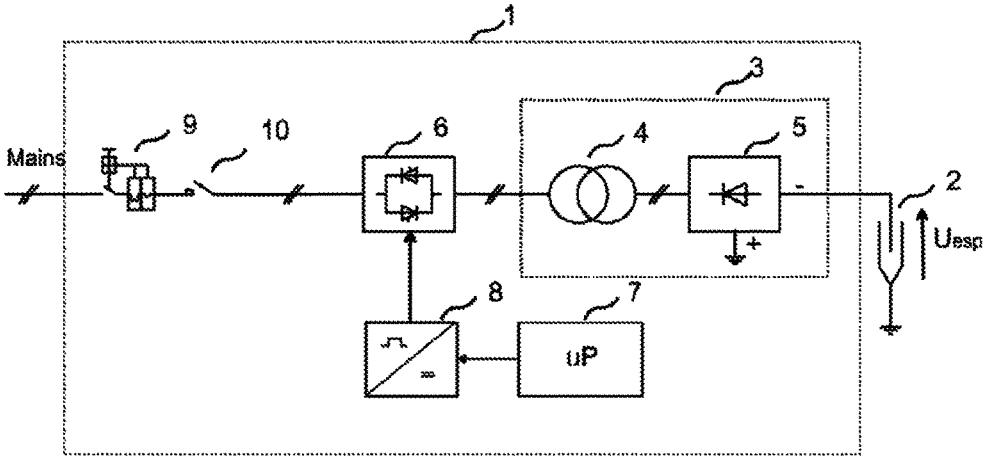
FIG. 1 shows a block diagram of an example of a high voltage power supply connected to an electrostatic precipitator.

FIG. 1 shows a block diagram of an example of a high voltage power supply 1 that can be used for e.g. the high voltage energization of electrostatic precipitators, such as the electrostatic precipitator 2 that is shown in the figure as a load for the high voltage power supply 1. The main unit in such high voltage power supply is a so-called transformer-rectifier set 3 (TR set), comprising a high voltage transformer 4 and a high voltage bridge rectifier 5. Transformer-rectifier sets can be single-phase or three-phase depending on the particular application of the electrostatic precipitator. The majority of the applications use single-phase transformer-rectifier sets, and the following description refers to this type. However, the main concepts will apply as well to three-phase transformer-rectifier sets. A transformer-rectifier set is normally immersed in a transformer oil filled tank.

In the embodiment shown in FIG. 1, the power delivered to the load, i.e. the electrostatic precipitator 2, can be regulated by controlling the primary side of the transformer-rectifier set 3 by a semiconductor switch controller 6 in the form of a thyristor controller, which may be mounted inside a control cabinet. The thyristor controller comprises a pair of thyristors connected in antiparallel, and it is sometimes also called an AC line regulator. Alternatively, in other embodiments a semiconductor switch controller utilizing other types of controllable semiconductor switches such as IGBTs (Insulated-Gate Bipolar Transistors), IGCTs (Integrated Gate-Commutated Thyristors), GTOs (Gate Turn-Off thyristors) or similar power semiconductors, may be used instead of the thyristor controller described here.

The controller uses the principle of phase control for varying continuously the power delivered to a load. Phase control means that the firing angle $\alpha$ (i.e. the phase angle at which e.g. a thyristor is fired or triggered in a given half period of the line frequency) of the individual thyristors may be delayed/increased (i.e. fired later) for decreasing the power delivered to the load or advanced/decreased (i.e. fired earlier) for increasing the power delivered to the load. The firing angle of the individual thyristors is determined in an automatic control unit 7 that may be microprocessor-based and then transmitted to firing circuitry 8, where the firing command is converted into two firing pulses 180° apart having the correct width, which are then applied to the gate of each thyristor.

The thyristor controller 6 and the transformer-rectifier set 3 may be protected by a circuit breaker 9 and can be connected and disconnected by means of a main contactor 10.

Figure 2:
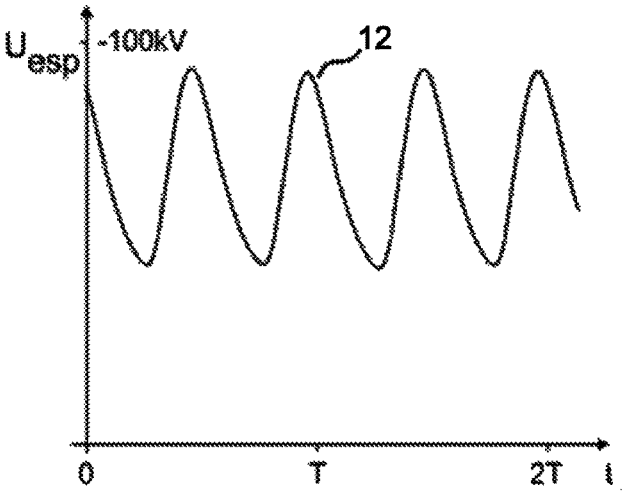
FIG. 2 shows an example of the voltage applied to an electrostatic precipitator by the high voltage power supply of FIG. 1.

FIG. 2 illustrates an example of the voltage 12 applied by the high voltage power supply 1 to the electrostatic precipitator 2. The output voltage is applied to the electrostatic precipitator 2 with negative polarity, so that a negative corona is generated inside the electrostatic precipitator for the particulate precipitation process, which is the normal situation in commercial electrostatic precipitators. However, for clarity reasons, the voltage is shown inverted in FIG. 2. The applied voltage has a relatively high ripple, which is defined as the difference between the peak value and the minimum value. In principle, the voltage level increases towards its peak value during the conducting period of the thyristors of the thyristor controller 6, i.e. the time period from a thyristor is fired (the firing angle) until the following zero crossing of the line voltage, while it decreases in the non-conducting periods. An earlier firing of the thyristors thus results in a higher value of the peak voltage. As mentioned above, the firing angle of the individual thyristors is determined in the automatic control unit 7 and then transmitted to the firing circuitry 8, where the firing command is converted into firing pulses, which are then applied to the gate of each thyristor. Thus the task of the automatic control unit 7 is to determine a firing angle $\alpha$ needed to obtain a given output voltage of the high voltage power supply 1.

The best electrostatic precipitator efficiency is achieved when the voltage applied to the electrostatic precipitator 2 is as high as possible. The limiting factor here is the breakdown of the gas treated by the electrostatic precipitator in the form of sparks or arcs that may occur at high voltages. During a spark or an arc the electrostatic precipitator voltage falls to a very low value. A spark has a very short duration, while the electrostatic precipitator voltage in case of an arc remains low as long as the surge current is present, which may be for several half periods of the line frequency.

After a breakdown, the electrostatic precipitator voltage must be recovered by firing the thyristor controller 6 again. Thus after the surge current has elapsed, the automatic control unit 7 needs to determine a new firing angle for the thyristor, so that the electrostatic precipitator voltage can be recovered as fast as possible. However, as mentioned before, this is not a simple task.

If a high voltage level is attained too fast, it may cause multiple sparking, i.e. new sparks may occur in the recovery period, which is detrimental for the efficiency of the electrostatic precipitator. On the other hand, a too slow recovery is also detrimental for the efficiency of the electrostatic precipitator.

The sparking level depends mainly on the gas composition, temperature and humidity, and the dust concentration as well. Thus the sparking level is not constant, and therefore, a quite common procedure is to reduce the voltage level after a breakdown by selecting a later firing angle than before the breakdown and then advancing the firing angle gradually for increasing the electrostatic precipitator voltage until a new spark occurs. In this way, the transformer-rectifier set 3 will be operated at a certain spark rate, commonly in the range 10-60 sparks/min. Normally, sparks occur around the peak of the electrostatic precipitator voltage, and thus the sparking level of the electrostatic precipitator voltage is referred to its peak voltage.

Figure 3:
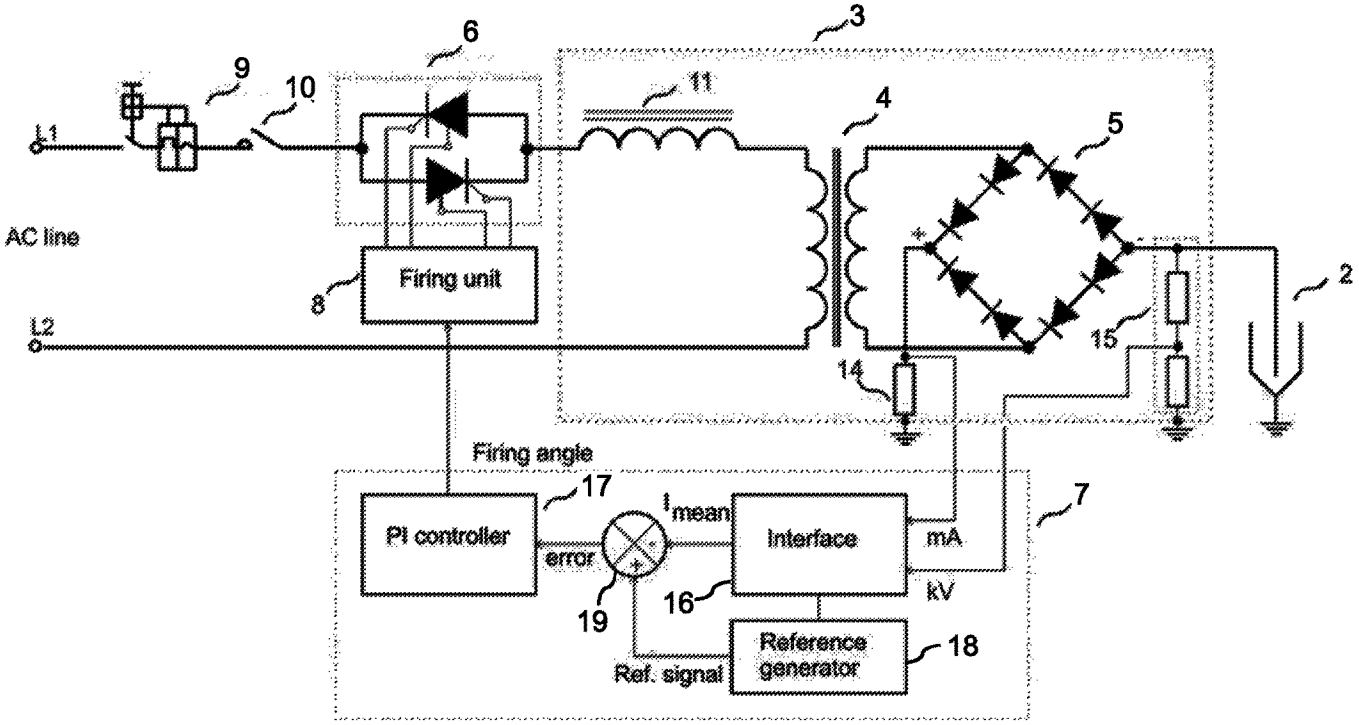
FIG. 3 shows a more detailed block diagram of an example of a high voltage power supply.

FIG. 3 shows a more detailed block diagram of the high voltage power supply 1 that can be used in the implementation of embodiments of the invention. As in FIG. 1, FIG. 3 shows the single-phase transformer-rectifier set 3 together with the thyristor controller 6, the firing circuitry 8 and the automatic control unit 7. Besides the high voltage transformer 4 and the high voltage bridge rectifier 5, the transformer-rectifier set 3 includes in this embodiment a linear choke 11. The linear choke 11 increases the short-circuit impedance to typically 30-40%, thus limiting the current level when sparks or arcs occur inside the electrostatic precipitator 2. The two diodes shown in each branch of the high voltage bridge rectifier 5 illustrate that due to the very high voltages a series connection of several diodes is normally used in each branch. The transformer-rectifier set 3 also comprises a resistor 14 for measuring the output current and a voltage divider 15 for measuring the output voltage. The use of these components will be described below.

Looking at the automatic control unit 7, this embodiment uses a closed-loop control of the mean output current from the power supply to determine a value of the firing angle to be used in each half period of the line frequency for performing the control actions needed to gradually increase the electrostatic precipitator voltage until a new spark occurs. A signal indicative of the output current is delivered by the resistor 14 to the automatic control unit 7, where it is filtered in an interface circuit 16 to obtain the mean value of the output current that can be used as a feedback signal in a PI (Proportional-Integral) controller 17. Other types of controllers may be used as well. The set point or reference signal for the controller is a ramp whose slope is calculated in a reference generator 18 and combined with the signal indicating the output mean current in a subtractor circuit 19 in order to keep the spark rate at a set value. The output of the PI controller 17 is the firing angle (a) transmitted to the firing circuitry 8 which generates the two firing pulses to be applied to the thyristor controller 6. When the set point is a linear ramp, the electrostatic precipitator mean current will increase linearly, and the electrostatic precipitator mean voltage will also increase, although not necessarily linearly.

As an alternative to the closed loop control of the mean output current, other embodiments may use a control ramp applied directly to the control of the firing angle. However, a ramp control alone of the firing angle is not optimal in performing an acceptable voltage recovery after spark. The ramp control will increase the electrostatic precipitator peak voltage by advancing the firing angle correspondingly. When sparks occur, the value of the control ramp is decreased slightly by a delay of the firing angle, performing the so-called voltage setback. However, due to the non-linear relationship between the peak voltage and the firing angle, it can be quite difficult to calculate a new firing angle to be used after a spark or an arc.

It has been found that in order to get a reduction of the peak voltage compared with the value before spark, normally a larger increase of the firing angle is needed for avoiding a new spark due to a too high peak voltage. Thus for the control schemes mentioned above, the determination of a firing angle to be used just after a spark or an arc can be improved as it will be described below.

The reason is that the transformer-rectifier set is normally operated at high voltage values, and the firing angle $\alpha$ consequently is at its low range value (e.g. 45-90°). This means that also the electrostatic precipitator voltage just before a thyristor firing, which corresponds to the lowest values of the voltage 12 in FIG. 2, is relatively high. This voltage acts as a counter-electromotive-force (c.e.m.f) that needs to be counteracted. Furthermore, a high operating voltage gives a high primary current and the high short-circuit impedance causes a corresponding considerable voltage drop in the transformer-rectifier set. But when a spark occurs, the capacitance of the electrostatic precipitator field is almost fully discharged, which results in a low counter-electromotive-force at the time of the next firing of the thyristor. Thus the first current pulse after the spark is only used to recharge the electrostatic precipitator field capacitance to a peak voltage which should be lower than the one previous to the spark; and this can be obtained with a considerably higher value of the firing angle compared with the angle before the spark ($\alpha_0$), because the counter-electromotive-force to be counteracted is much lower.

Figure 4:
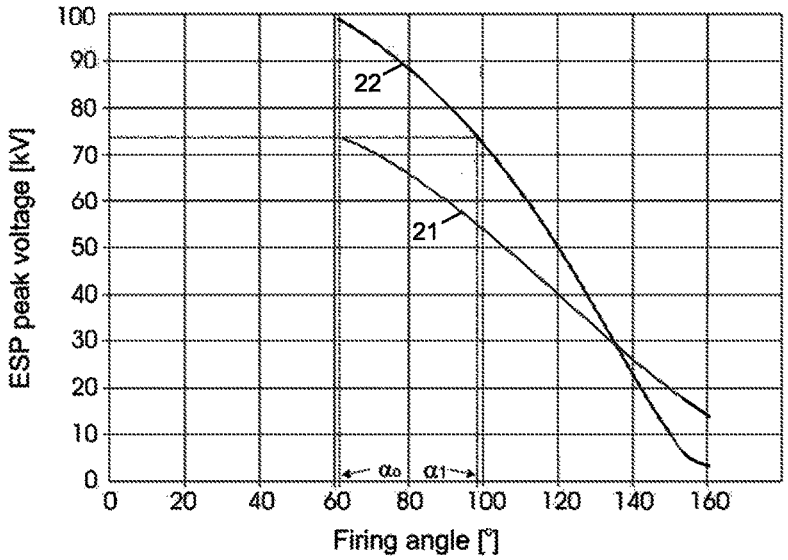
FIG. 4 shows curves illustrating the relationship between an attainable peak value of the electrostatic precipitator voltage and a firing angle of a thyristor controller under normal operation and after a breakdown, respectively.

This is illustrated in FIG. 4 showing an example of a relationship between the attainable peak value of the electrostatic precipitator voltage and the firing angle of the corresponding thyristor controller. The curves in FIG. 4 are shown only for illustrational purposes and do not necessarily correspond to a particular power supply and electrostatic precipitator. The peak value of the electrostatic precipitator voltage is shown in the ordinate axis in [kV]. The curves of FIG. 4 have been obtained by performing computer simulations on an equivalent circuit of the power supply and the electrostatic precipitator. Curve 21 shows the attainable peak value of the electrostatic precipitator voltage as a function of the firing angle during normal operation without spark, i.e. when a relatively high counter-electromotive-force has to be counteracted. Curve 22 shows the attainable peak value of the electrostatic precipitator voltage as a function of the firing angle when the electrostatic precipitator capacitance is recharged from a low residual voltage, i.e. when a low counter-electromotive-force has to be counteracted. Curves 21 and 22 show that when $\alpha$ is below 135°, using the same firing angle in the first half-period of the voltage recovery as before the spark will give a higher peak voltage than required. The normal setback of $\alpha$ is not sufficient to achieve the aimed level of about 70-80% of the peak voltage before the spark.

As an example referring to FIG. 4, it can be supposed that the transformer-rectifier set is running at a high output voltage with firing angle $\alpha_0$=62° giving a peak value equal to 74 kV according to curve 21. After a spark, the firing angle to be used, if the electrostatic precipitator voltage should be recovered to the same value as before the spark, should be $\alpha_1$=98° as determined by curve 22. If the firing angle is not delayed in relation to $\alpha_0$, the peak voltage would reach almost 100 kV, with a high probability of a new spark.

In practice, however, since it is common to reduce the peak voltage after a spark to a setback level and then gradually increase it again until a new spark occurs in order to obtain a certain spark rate, the peak voltage after the spark should be lower than before the spark, and therefore, the firing angle $\alpha_1$ should be even further delayed. If, as an example, the setback level of the peak voltage is selected to 80% of the previous peak voltage (74 kV in the above example), the intended peak voltage ($U_{set}$) after the spark should be 59 kV, and from curve 22 of FIG. 4 it can be seen the firing angle should then be delayed from $\alpha_0$=62° to $\alpha_1$=112°. Since the intended peak voltage after the spark is typically selected to a percentage of the peak voltage just before the spark, this peak voltage just before the spark should be known, which is achieved by means of the voltage divider 15 for measuring the electrostatic precipitator voltage. From this measurement, the automatic control unit 7 can then in each half period of the line frequency determine and store the peak voltage value. After a spark the new firing angle to be used can then be determined based on the stored value of the peak voltage value just before the spark. Alternatively, the automatic control unit 7 can also calculate e.g. an average of stored peak voltage values just before a number of previous sparks.

Thus the curves of FIG. 4 can be used for determining a firing angle to be used just after the occurrence of a spark or an arc in order to obtain an improved voltage recovery in an electrostatic precipitator.

However, as mentioned, the curves of FIG. 4 are shown only as an example. They depend on e.g. the capacitance of the electrostatic precipitator energized by the transformer-rectifier set and other specifications or variables of the electrostatic precipitator and the transformer-rectifier set. For a specific electrostatic precipitator and transformer-rectifier set the corresponding curves can be determined by computer simulations or based on measurements performed on the components. Thus the shown curves can be considered as being valid for a certain rated voltage $U_{nom}$ of the transformer-rectifier set and the installed current density J (in [mA/m$^2$]), i.e. the rated mean current of the transformer-rectifier set divided by the collecting plate area (in [m$^2$]) of the field energized by the transformer-rectifier set. In other words, J is an indirect expression of the electrostatic precipitator field capacitance, which is approximately 30 pF/m$^2$ for modern electrostatic precipitators. As J and $U_{nom}$ vary from application to application, curves 21 and 22 may also vary or be displaced somewhat compared with FIG. 4.

Furthermore, there will often be a residual voltage ($U_r$) just after the spark that is not zero. It can jump up to tens of kilovolts. This residual voltage also acts as a counter-electromotive-force, and therefore the firing angle should be adjusted accordingly. i.e. advanced for higher values of the residual voltage. This is illustrated with an example in FIG. 5, where the attainable peak voltage is shown as a function of the firing angle $\alpha_1$ for different values of the residual voltage for a transformer-rectifier set having a rated (nominal) voltage ($U_{nom}$) of 100 kV. Note that in FIG. 5 the aimed peak voltage after a spark is expressed as a relative value ($u_{set}$) in relation to the nominal voltage of the transformer-rectifier set, i.e. $u_{set}=U_{set}/U_{nom}$. Curve 23 corresponds to curve 22 of FIG. 4 (although not necessarily under identical conditions), i.e. it shows the situation where there is no or a very low residual voltage after the spark ($U_r$=0). Correspondingly, curves 24, 25 and 26 show the attainable peak voltage for residual voltages of e.g. 10 kV, 20 kV and 30 kV, respectively. Thus curve 24 represents a relatively low $U_r$ and curve 26 a high $U_r$. If, for instance, the level to be reached after the spark is 84% of the rated value ($U_{nom}$) and $U_r$ is very low (curve 23) then the required firing angle would be 105°, but if $U_r$ is high (curve 26) then the required firing angle should be 95°. Since the curves of FIG. 5 show the relative aimed peak voltage, they can be used more generally, but similarly to FIG. 4 they still depend on the installed current density J, i.e. on the electrostatic precipitator field capacitance.

Figure 6:
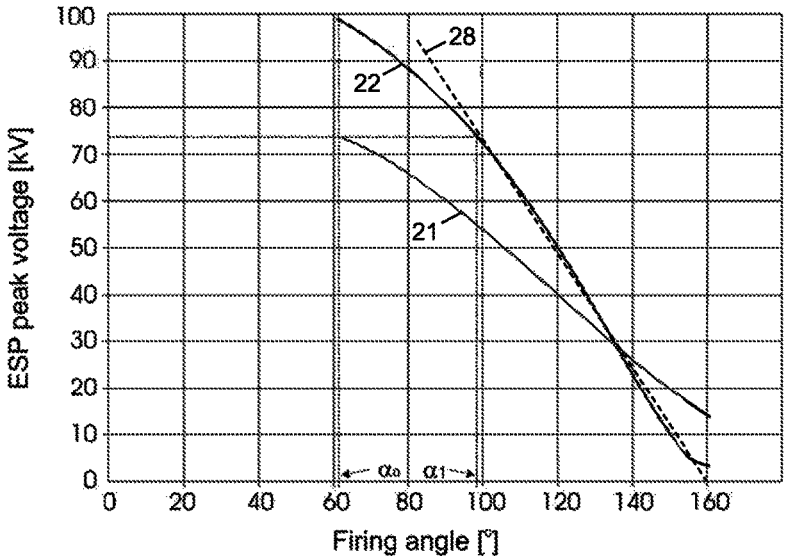
FIG. 6 shows how one of the curves of FIG. 4 can be approximated by a linear function.

It can be seen that at least in the firing angle range from 100° to 150° curve 22 of FIG. 4 can be approximated by a linear function represented by the line 28 shown in FIG. 6. Typically, the required firing angle will be in this range. Firing angles above 150° will only rarely be used, because the attainable peak voltage would be too low to provide a sufficient efficiency of the electrostatic precipitator. A linear function makes it much easier to determine a mathematical expression that can be used by the automatic control unit 7 in calculating a firing angle to be used just after a spark based on these curves. In this example, the line 28 crosses the x axis at 160°.

Figure 5:
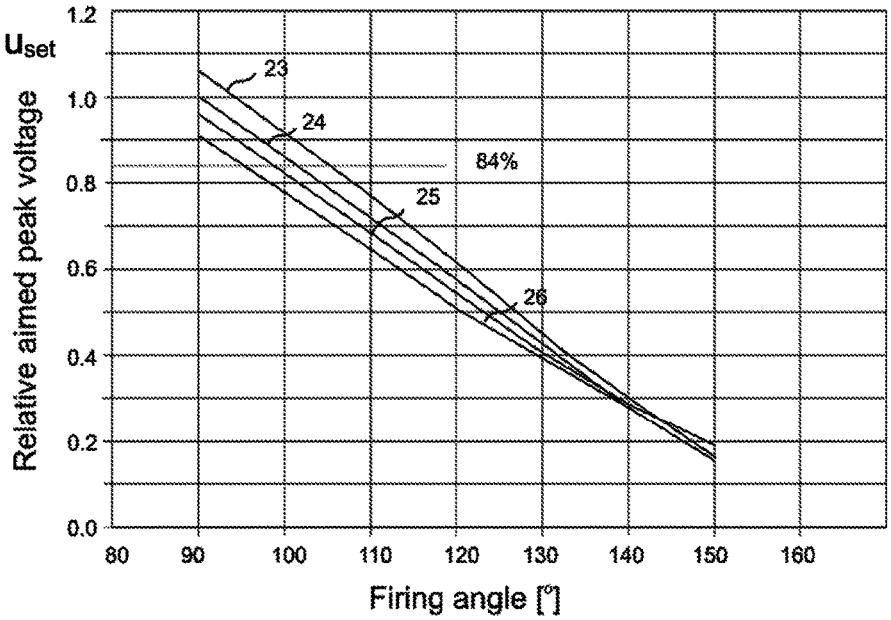
FIG. 5 shows a set of curves corresponding to FIG. 4 for different values of a residual voltage over the electrostatic precipitator after a breakdown.
Figure 7:
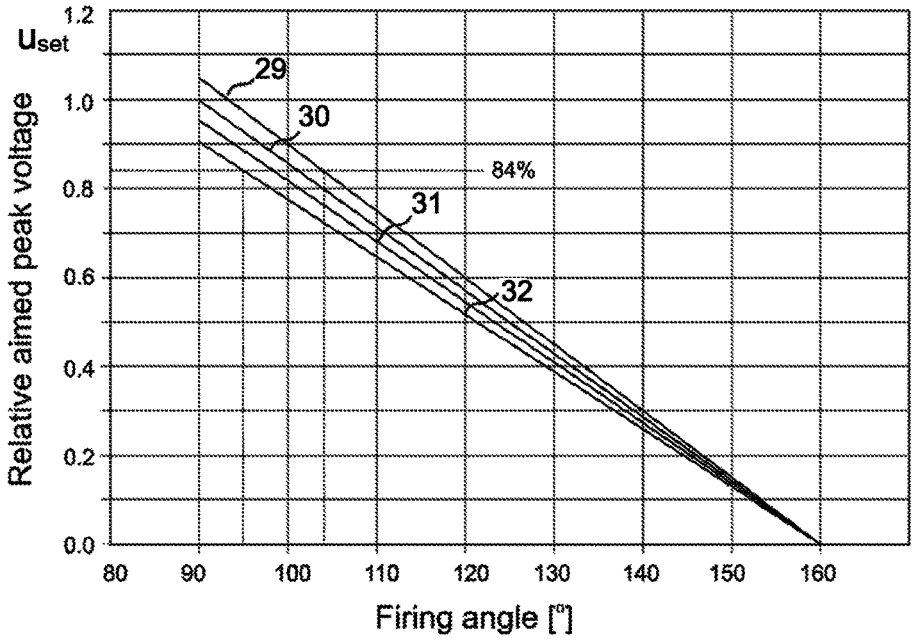
FIG. 7 shows corresponding linear approximations of the curves of FIG. 5.

Similarly, the curves in FIG. 5 showing the attainable peak voltage just after a spark as a function of the used firing angle for different values of the residual voltage can be approximated in the relevant range by linear functions. An example of this is shown in FIG. 7, wherein the approximated attainable voltage as a function of the firing angle $\alpha_1$ is shown for four values of the residual voltage $U_r$, 29, 30, 31 and 32, where curve 29 represents a very low $U_r$ and curve 32 a high $U_r$. Also here, the aimed peak voltage after a spark is expressed as a relative value ($u_{set}$) in relation to the rated (nominal) voltage of the transformer-rectifier set, i.e. $u_{set}=U_{set}/U_{nom}$. Similar to line 28 in FIG. 6, also these lines cross the x-axis at 160°, but this value may vary with the parameters of the power supply and the electrostatic precipitator. If the level to be reached after the spark is 84% of the rated value ($U_{nom}$) and $U_r$ is very low (curve 29) then the required firing angle is 104°, but if $U_r$ is high (curve 32) then the required firing angle should be 95°.

Thus the curves of FIG. 7 show a very good approximation of the attainable relative peak voltage $U_{set}$ as a function of a first firing angle $\alpha_1$ used just after the occurrence of a spark for different residual voltages, and therefore they can be used to determine a firing angle $\alpha_1$ that will provide an aimed relative peak voltage in the first half period after the spark.

Figure 8:
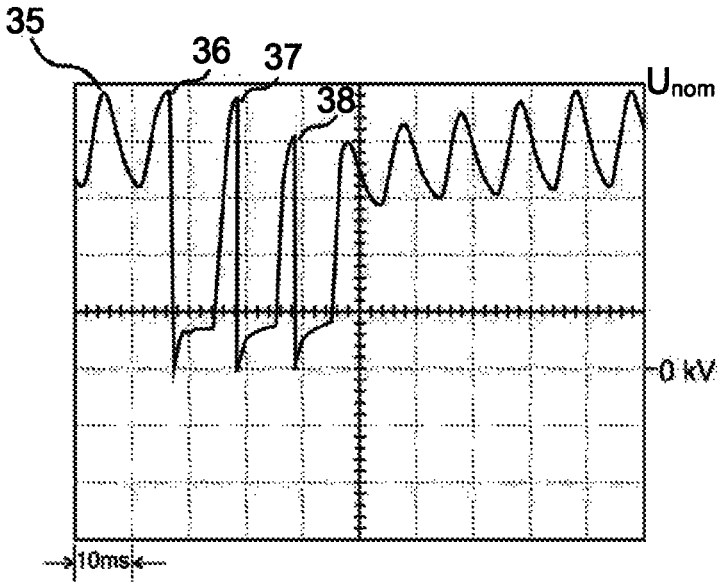
FIG. 8 shows an example of an electrostatic precipitator voltage in case of multiple sparking due to too fast voltage recovery.
Figure 9:
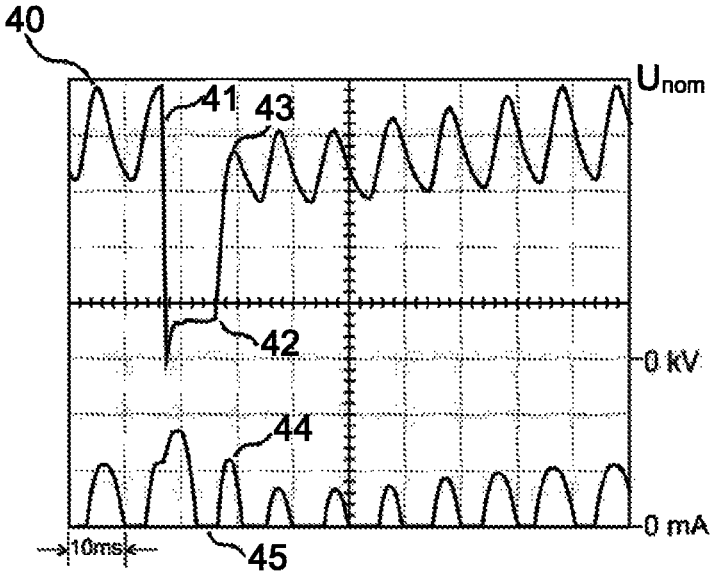
FIG. 9 shows an example of an electrostatic precipitator voltage in case of voltage recovery according to the invention.

The effect of determining the firing angle to be used just after a spark in this way is illustrated in FIGS. 8 and 9 showing waveforms of the voltage applied to an electrostatic precipitator field and (in FIG. 9) the corresponding electrostatic precipitator current before and after a spark. The figures show oscillograms taken from the real world. As mentioned before, the electrostatic precipitator voltage is negative, but in FIGS. 8 and 9 it is shown with inverted polarity for the sake of clarity.

FIG. 8 shows a situation resulting in multiple sparking because the voltage is recovered too fast. The peak voltage 35 before the spark ($U_{bef}$) is in this case around 97% of the rated voltage. When a spark 36 takes place the voltage falls instantaneously to zero and then rests at the so-called residual value ($U_r$) during the time interval where the electrostatic precipitator current is zero, i.e. until the thyristor is fired again. However, in this case, since the firing angle is not delayed sufficiently, the voltage is recovered too fast, and a second spark 37 occurs. The situation is repeated, and a third spark 38 occurs before the normal operation can start again. Such multiple sparking is detrimental to the efficiency of the electrostatic precipitator, but since a too slow voltage recovery is also detrimental to the efficiency (especially if blocking periods, where no energy is delivered to the electrostatic precipitator, are introduced for avoiding multiple sparking), it has a high importance to find an optimal value of the firing angle to be used for the first firing pulse after a spark.

In FIG. 9 a situation is shown, in which the firing angle to be used just after a spark is determined from the curves of FIG. 7 as described above. Again, the peak voltage 40 before the spark ($U_{bef}$) is around 97% of the rated voltage, and when a spark 41 takes place the voltage falls instantaneously to zero and then rests at the residual value 42 ($U_r$) during the time interval 45 where the electrostatic precipitator current is zero, i.e. until the thyristor is fired again. Then, using a firing angle calculated by the control unit 7 according to the principles described above, the electrostatic precipitator capacitance is recharged to an aimed value 43 ($U_{set}$), which is lower than the peak value 40 before the spark. The attained peak voltage 43 with the first current pulse 44 is in this case about 74% of the rated value or 76% of the peak value before the spark. A rule of thumb states that the aimed level (setback level $l_{set}$) should be about 80% of the peak value before the spark in order to avoid a new spark during the voltage recovery. Higher levels would increase the probability of occurrence of multiple sparking. The shown voltage recovery after spark can be considered as quite acceptable for a person skilled in the art.

FIG. 9 also shows that the first current pulse 44 after the spark is higher than those before the spark. This occurs if the closed-loop control of the mean current is opened. Maintaining it would give a current pulse with lower amplitude because of the normal setback and this would cause in turn a lower peak voltage, i.e. lower than the aimed level which is equivalent to a poorer voltage recovery.

The automatic control unit 7 should therefore be able to determine an appropriate firing angle to be used just after a spark based on the curves shown in FIG. 7 and the detected or measured values of the peak voltage just before the spark ($U_{bef}$) and the residual voltage ($U_r$) just after the spark in combination with a selected setback level $l_{set}$, i.e. the aimed peak voltage ($U_{set}$) to be recovered after the spark divided by $U_{bef}$. Therefore, a mathematical expression for the aimed peak voltage $U_{set}$ after the spark as a function of the first firing angle $\alpha_1$ after the spark for different values of J and $U_{nom}$ is described below. In the mathematical expression the following variables and parameters, of which some have already been mentioned above, are used:

$U_{nom}$ is the rated voltage of the transformer-rectifier set;
$U_{bef}$ is the peak voltage before a spark or an arc;
$U_r$ is the residual voltage just after a spark or an arc;
$U_{set}$ is the aimed peak voltage after a spark or an arc;
$u_{set}$ is the relative aimed peak voltage after a spark or an arc, i.e. $u_{set}=U_{set}/U_{nom}$;
$l_{set}$ is the setback level, i.e. $l_{set}=U_{set}/U_{bef}$;
J is the installed current density as described above;
m is the slope of each curve of FIG. 7;
$\alpha_1$ is the firing angle to be determined just after a spark or an arc;
$\alpha_{Lim}$ is the firing angle at which the lines in FIG. 7 meet at zero peak voltage, i.e. in the example of FIG. 7 $\alpha_{Lim}$ is about 160°;
$\alpha_x$ is the firing angle to be subtracted from $\alpha_{Lim}$ to get $\alpha_1$;
A, B, C, and D are coefficients depending on the value of the current density J as it will be described below.

The curves 29, 30, 31 and 32 in FIG. 7 can be determined by computer simulation or by finding the corresponding mathematical expressions. The curves are linear, so $\alpha_1$ can be represented by:

$$\alpha_1 = \alpha_{Lim} - \frac{1}{m}u_{set} = \alpha_{Lim} - \alpha_x. \tag{1}$$

It is possible to demonstrate that $\alpha_x$ (equal to $u_{set}/m$) can be expressed by equation (2):

$$\alpha_x = \frac{u_{set}}{m} = [(A \cdot U_{nom} + B) \cdot U_r + C \cdot U_{nom} + D] \cdot u_{set}. \tag{2}$$

The coefficients A, B, C and D are determined by linear regression and are found to be:

$$A=a_2 \cdot J^2+a_1 \cdot J+a_0 \tag{3}$$

$$B=b_2 \cdot J^2+b_1 \cdot J+b_0 \tag{4}$$

$$C=c_2 \cdot J^2+c_1 \cdot J+c_0 \tag{5}$$

$$D=d_2 \cdot J^2+d_1 \cdot J+d_0 \tag{6}$$

As an example, the lowercase coefficients can be:

| | | |
|---|---|---|
| $a_2 = 0.045$ | $a_1 = 0.045$ | $a_0 = 0.01$ |
| $b_2 = 5.5$ | $b_1 = 0.64$ | $b_0 = 1.8$ |
| $c_2 = 1.01$ | $c_1 = 1.32$ | $c_0 = 0.48$ |
| $d_2 = 50.0$ | $d_1 = 63.5$ | $d_0 = 42.3$ |

Since the relative aimed peak voltage $u_{set}$ can be written as $$u_{set} = \frac{U_{set}}{U_{nom}} = \frac{l_{set} \cdot U_{bef}}{U_{nom}},$$

equation (2) can also be written as $$\alpha_x = [(A \cdot U_{nom} + B) \cdot U_r + C \cdot U_{nom} + D] \cdot \frac{l_{set} \cdot U_{bef}}{U_{nom}}. \tag{7}$$

For a given power supply and electrostatic precipitator, $U_{nom}$ and J (and thus also the coefficients A, B, C and D) have known and fixed values. Typically, also the setback level $l_{set}$ will have been selected to a fixed value, so that the peak voltage before the spark $U_{bef}$ and the residual voltage $U_r$ are the only variables. This means that equation (7) can also be written as $$\alpha_x = (K_1 \cdot U_r + K_2) \cdot U_{bef}, \tag{8}$$

where $$K_1 = \frac{(A \cdot U_{nom} + B) \cdot l_{set}}{U_{nom}} \tag{9}$$

and $$K_2 = \frac{(C \cdot U_{nom} + D) \cdot l_{set}}{U_{nom}}. \tag{10}$$

From equation (1), it can then be seen that the needed firing angle $\alpha_1$ can be calculated as $$\alpha_1=\alpha_{Lim}-\alpha_x=\alpha_{Lim}-(K_1\cdot U_r+K_2)\cdot U_{bef}. \quad (11)$$

Thus as it will be described below in relation to FIG. 10, the above coefficients and equations may be included in the software of the microprocessor based automatic control unit together with the parameters $U_{nom}$, J and the aimed setback level $l_{set}$. As the control unit measures the peak voltage before the spark ($U_{bef}$) and the residual voltage $U_r$ few milliseconds after the spark, then the needed firing angle $\alpha_1$ can be calculated and used in the first thyristor firing after the spark according to equation (11).

Figure 10:
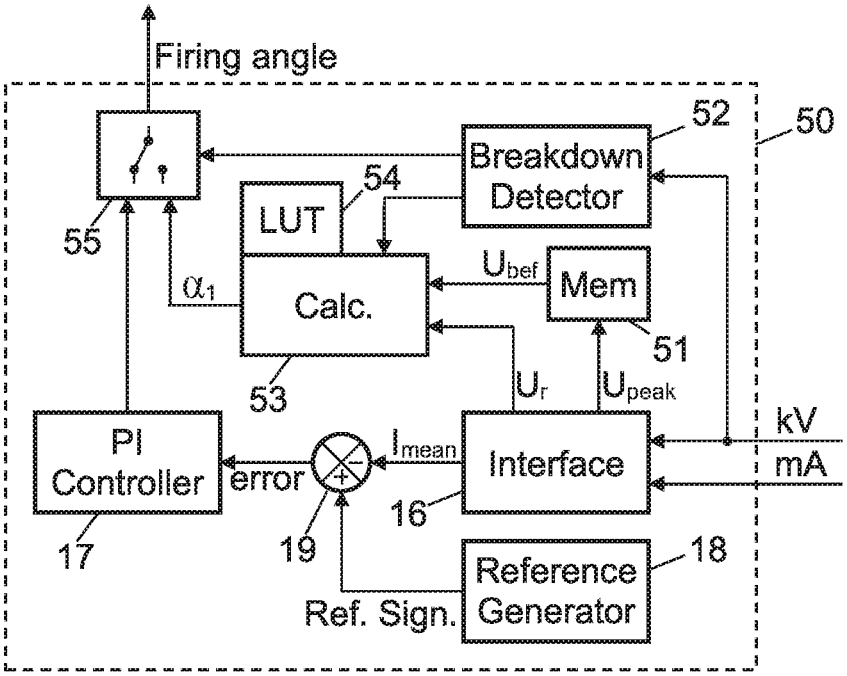
FIG. 10 shows a block diagram of a control unit according to the invention.

FIG. 10 shows a block diagram of an embodiment of an automatic control unit 50 capable of calculating the needed firing angle $\alpha_1$ to be used in a first thyristor firing after the occurrence of a spark or an arc. During normal operation, i.e. without the occurrence of any spark or arc, the automatic control unit 50 uses, similarly to the automatic control unit 7 in FIG. 3, a closed-loop control of the mean output current from the power supply to determine a value of the firing angle to be used in each half period of the line frequency for performing the control actions needed to gradually increase the electrostatic precipitator voltage until a new spark occurs. A signal (mA) indicative of the output current is delivered by the resistor 14 of FIG. 3 to the automatic control unit 50, where it is filtered in the interface circuit 16 to obtain the mean value of the output current that can be used as a feedback signal in the PI (Proportional-Integral) controller 17. The set point or reference signal for the controller is a ramp whose slope is calculated in a reference generator 18 and combined with the signal indicating the output mean current in a subtractor circuit 19 in order to keep the spark rate at a set value. The output of the PI controller 17 is the firing angle ($\alpha$) transmitted to the firing circuitry 8 of FIG. 3, which generates the two firing pulses to be applied to the thyristor controller 6.

Further, a signal (kV) indicative of the electrostatic precipitator voltage is delivered by the voltage divider 15 of FIG. 3 to the automatic control unit 50, where it is filtered in the interface circuit 16 to determine the peak value ($U_{peak}$) of the output voltage in each half period of the line frequency. The peak values are then stored in the memory 51 for later use.

However, when a breakdown, i.e. a spark or an arc, occurs, this is detected from the signal (kV) indicative of the electrostatic precipitator voltage in a breakdown detector 52, which then as a consequence instructs a calculation unit 53 to calculate a firing angle $\alpha_1$ that can be used in the first thyristor firing after the break-down. The calculation unit 53 reads the value of the peak voltage before the spark ($U_{bef}$) from the memory 51 and the value of the residual voltage $U_r$ few milliseconds after the spark from the interface circuit 16, and the needed firing angle $\alpha_1$ can then be calculated according to equation (11).

In one embodiment, the coefficients and equations mentioned above may be included in the software of the calculation unit 53 together with the parameters $U_{nom}$, J and the aimed setback level $l_{set}$, so that the needed firing angle $\alpha_1$ can be calculated directly based on the values of the peak voltage before the spark ($U_{bef}$) and the residual voltage $U_r$.

Alternatively, the needed firing angle $\alpha_1$ may be pre-calculated for different values of the peak voltage before the spark ($U_{bef}$) and the residual voltage $U_r$ and stored in a look-up table 54. When a breakdown is detected, the calculation unit 53 reads the value of the peak voltage before the spark ($U_{bef}$) from the memory 51 and the value of the residual voltage $U_r$ few milliseconds after the spark from the interface circuit 16, and the needed firing angle $\alpha_1$ can then be found in the look-up table 54.

The breakdown detector 52 also controls a switch 55 that in case of a breakdown opens the normal closed-loop control of the mean output current from the power supply that under normal operation determined the value of the firing angle to be used in each half period of the line frequency. Instead, the firing angle $\alpha_1$ determined by the calculation unit 53 can now be transmitted to the firing circuitry 8 of FIG. 3, which generates the firing pulse to be applied to the thyristor controller 6 for the first thyristor firing after the breakdown.

After the first thyristor firing the control unit 50 can revert to the closed-loop control of the mean current of the electrostatic precipitator based on a new ramp slope calculated in the reference generator 18. However, in some situations it may be advantageous, if the second firing angle $\alpha_2$ can be calculated in the same way as $\alpha_1$, by measuring the residual voltage $U_r$ attained after the first current pulse (44 in FIG. 9) using $\alpha_1$. Thus, another embodiment is to calculate the second firing angle $\alpha_2$ in a similar manner and then reverting to the closed-loop control of the mean current of the electrostatic precipitator.

As mentioned above, in some cases arcs may occur inside the electrostatic precipitator, in which case the residual voltage after the gas break-down remains very low as long as the surge current is present, which may be for several half periods of the line frequency. The occurrence of an arc can be detected by the breakdown detector 52 from the signal (kV) indicative of the electrostatic precipitator voltage, e.g. by checking if the voltage remains very low after the first thyristor firing after what was first considered to be a spark. If the voltage increases as it was illustrated in FIG. 9, the breakdown was a spark, but if the voltage remains at a very low level after the firing of the thyristor, an arc seems to have occurred. In case of an arc, a blocking period, a so-called 'quench time', of few half-periods, i.e. two to four half periods, where the thyristors are not fired, can be introduced as a precaution. Typically, the quench time can be 20 ms. After the quench time has elapsed, the voltage recovery can be performed in a similar manner as in case of sparks and where the residual voltage $U_r$ during the quench time is measured and used in the calculation of the first firing angle $\alpha_1$.

Figure 11:
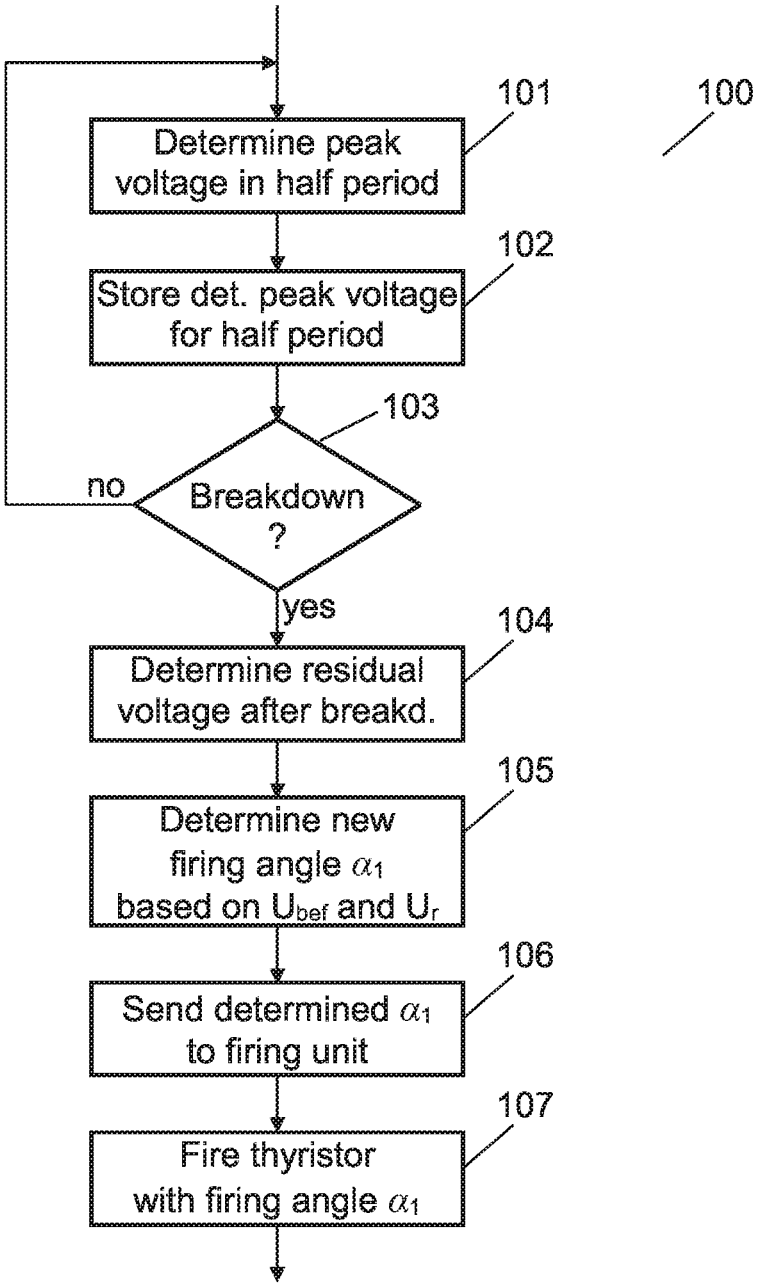
FIG. 11 shows a flow chart illustrating a method of determining a firing angle to be used by a thyristor controller after the occurrence of a breakdown.
Figure 12:
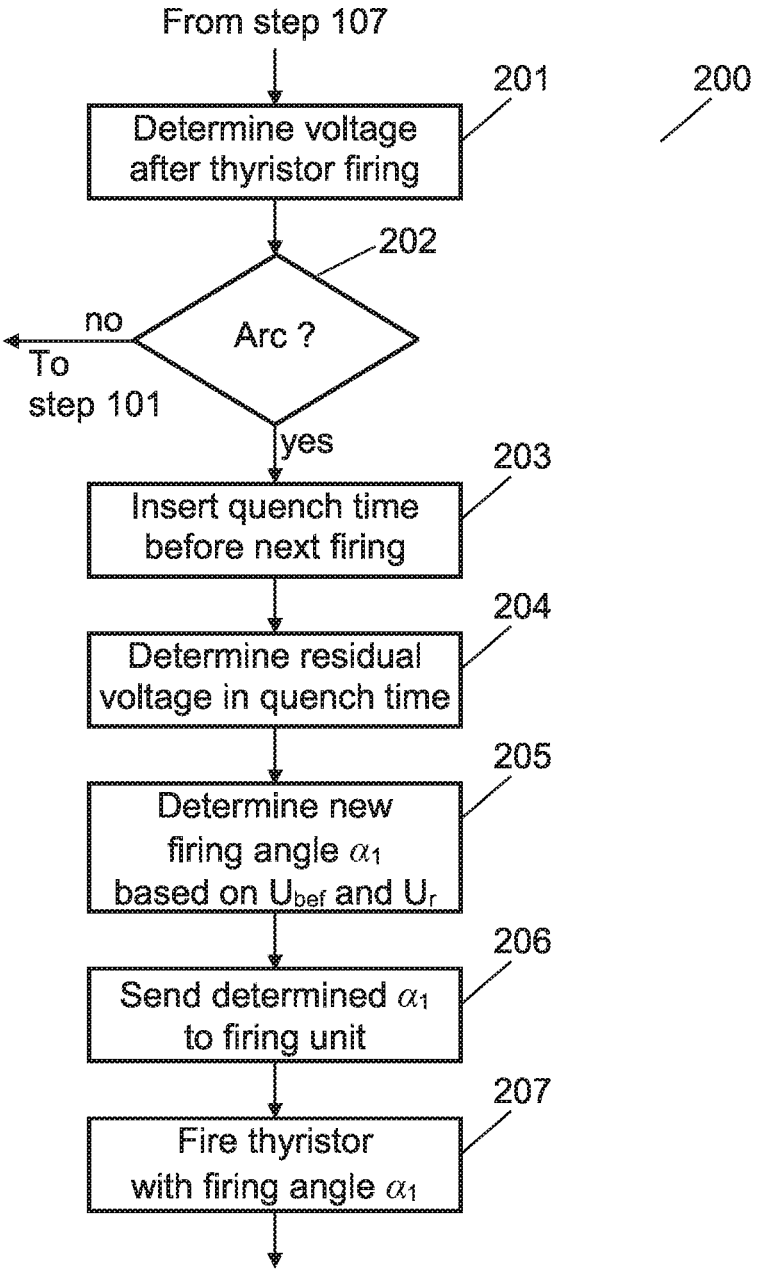
FIG. 12 shows a flow chart illustrating a method of determining a firing angle to be used in case of arcing in the electrostatic precipitator.

FIG. 11 shows a flow chart illustrating a method of controlling a high voltage power supply for an electrostatic precipitator. In step 101, which is performed in each half period of the line frequency under normal operation of the high voltage power supply, i.e. without the occurrence of any breakdowns, the peak value of the electrostatic precipitator voltage in this half period is determined in the interface circuit 16 of FIG. 10. The determined peak voltage is then in step 102 stored in the memory 51. In step 103, it is checked whether a breakdown has been detected by the breakdown detector 52 in this half period. If this is not the case, the above steps are repeated in the following half period of the line frequency.

If, however, a breakdown was detected in step 103, the residual voltage $U_r$ after the breakdown is determined by the interface circuit 16 in step 104. The determined residual voltage $U_r$ is then supplied to the calculation unit 53 together with the peak voltage $U_{bef}$ before the breakdown, which is read from the memory 51, and the calculation unit 53 determines in step 105 a new firing angle $\alpha_1$ to be used after the breakdown based on the values $U_r$ and $U_{bef}$. As mentioned above, this can be done e.g. by including the coefficients and equations previously described in the calculation unit 53, so that the needed firing angle $\alpha_1$ can be calculated directly based on the values of the peak voltage before the spark ($U_{bef}$) and the residual voltage $U_r$, or by having stored pre-calculated values of the needed firing angle $\alpha_1$ for different values of the peak voltage before the spark ($U_{bef}$) and the residual voltage $U_r$ in a look-up table 54. The determined firing angle $\alpha_1$ is then sent to the firing circuitry 8 in step 106, and in step 107, the thyristor of the thyristor controller 6 is fired with this firing angle $\alpha_1$.

The control unit 50 can now revert to the closed-loop control of the mean current of the electrostatic precipitator based on a new ramp slope calculated in the reference generator 18. However, in some situations it may be advantageous, if the second firing angle $\alpha_2$ can be calculated in the same way as $\alpha_1$, by measuring the residual voltage $U_r$ attained after the first current pulse (44 in FIG. 9) using $\alpha_1$. In this situation, steps 104 to 107 may be repeated for calculating the second firing angle $\alpha_2$ in a similar manner and then reverting to the closed-loop control of the mean current of the electrostatic precipitator.

As mentioned, a breakdown may be either a spark or an arc. To distinguish between the two types, the flow chart 100 may be continued with the steps shown in flow chart 200 described below. After the firing of the thyristor in step 107, the resulting electrostatic precipitator voltage is determined by the breakdown detector 52 from the signal (kV) indicative of the electrostatic precipitator voltage in step 201. Based on the result, it is checked in step 202 whether the breakdown was a spark or an arc. If the voltage increases as illustrated in FIG. 9, the breakdown was a spark and the method can be continued by reverting to the closed-loop control of the mean current of the electrostatic precipitator based on a new ramp slope calculated in the reference generator 18. The method then continues in step 101 in the next half period of the line frequency.

However, if the voltage remains at a very low level after the firing of the thyristor, an arc seems to have occurred, and a so-called quench time, e.g. of 20 ms, is inserted in step 203 before the next firing of the thyristors. During the quench time the residual voltage $U_r$ is measured in step 204 and used in the calculation of the first firing angle $\alpha_1$. Based on this residual voltage $U_r$ and the previous peak voltage $U_{bef}$ the calculation unit 53 can now in step 205 determine a new firing angle $\alpha_1$ to be used after the quench time has elapsed in the same way as described for step 105 above. The determined firing angle $\alpha_1$ is then sent to the firing circuitry 8 in step 206, and in step 207, the thyristor of the thyristor controller 6 is fired with this firing angle $\alpha_1$.

In other words, a method of controlling a high voltage power supply for an electrostatic precipitator is disclosed, wherein said high voltage power supply comprises a transformer-rectifier set comprising a high voltage transformer, a primary side of which is connectable to an AC industrial mains net having a line frequency, and a high voltage bridge rectifier connected to a secondary side of said high voltage transformer and configured to supply a rectified high voltage to said electrostatic precipitator; a semiconductor switch controller arranged at the primary side of said high voltage transformer and configured to control an output power level of the high voltage power supply; firing circuitry configured to provide firing pulses to said semiconductor switch controller; and a control unit configured to determine a firing angle of said firing pulses and to control said firing circuitry accordingly. The method comprises the steps of measuring during normal operation of said electrostatic precipitator a peak voltage value over said electrostatic precipitator in each half period of said line frequency; storing said measured peak voltage value; detecting the occurrence of an electrical breakdown in said electrostatic precipitator; measuring, when a breakdown is detected, a residual voltage over the electrostatic precipitator; determining a firing angle of a firing pulse to be provided to said semiconductor switch controller in the first half period after the occurrence of said breakdown, wherein said firing angle is determined from the latest stored measured peak voltage value and the measured residual voltage based on a predetermined relationship between said firing angle and the latest stored measured peak voltage value and the measured residual voltage; and providing a firing pulse with the determined firing angle to said semiconductor switch controller.

When the peak voltage just before a breakdown and the residual voltage just after the breakdown are measured, and a new firing angle is determined from these measured values and a predetermined relationship between them and an appropriate firing angle, an improved voltage recovery of the electrostatic precipitator can be achieved.

In some embodiments, the method further comprises the step of determining said predetermined relationship with said firing angle and the latest stored measured peak voltage value and the measured residual voltage by performing computer simulations on a model of said electrostatic precipitator and said transformer-rectifier set. This allows a relatively precise determination of the relationship. Alternatively, the predetermined relationship may be determined based on measurements performed on the components of the power supply and the electrostatic precipitator.

The method may further comprise the step of approximating said predetermined relationship by a set of linear functions, wherein each linear function defines an approximated relationship between an aimed peak voltage value and said firing angle for a value of measured residual voltage. Such approximation simplifies the determination of the desired firing angle.

The method may further comprise the step of providing a mathematical expression representing each of said linear functions, so that said firing angle can be calculated from the latest stored measured peak voltage value and the measured residual voltage using said mathematical expression. This allows the firing angle to be calculated by a calculation unit.

In such case, the method may further comprise the step of calculating said firing angle on-line from the latest stored measured peak voltage value and the measured residual voltage using said mathematical expression when a breakdown has been detected.

Alternatively, the method may further comprise the steps of pre-calculating said firing angle for different values of the peak voltage before the breakdown and the residual voltage using said mathematical expression; storing the pre-calculated firing angle values together with corresponding values of the peak voltage before the breakdown and the residual voltage in a look-up table; and reading, when a breakdown has been detected, a pre-calculated firing angle value corresponding to the latest stored measured peak voltage value and the measured residual voltage from said look-up table.

In some embodiments, the method may further comprise the steps of using under normal operation of said electrostatic precipitator a closed-loop control of a mean output current from the power supply to determine a value of the firing angle to be used in each half period of the line frequency; opening, when a breakdown is detected, said closed-loop control; determining a firing angle from the latest stored measured peak voltage value and the measured residual voltage; and providing a first firing pulse with the determined firing angle to said semiconductor switch controller.

In this case, the method may further comprise the step of reverting to the closed-loop control of the mean output current from the power supply to determine the value of the firing angle to be used in each half period of the line frequency when the semiconductor switch controller has been fired with said first firing pulse.

Alternatively, the method may further comprise the steps of determining, when the semiconductor switch controller has been fired with said first firing pulse, a further firing angle from the latest stored measured peak voltage value and a residual voltage measured after said first firing pulse; providing a second firing pulse with the determined further firing angle to said semiconductor switch controller; and reverting to the closed-loop control of the mean output current from the power supply to determine the value of the firing angle to be used in each half period of the line frequency when the semiconductor switch controller has been fired with said second firing pulse.

In some embodiments, the method may further comprise the steps of determining by measuring an output voltage of the power supply whether the detected break-down is a spark or an arc; inserting, if the detected breakdown is an arc, a blocking period of a few half-periods, where the semiconductor switch controller is not fired: determining after said blocking period a firing angle of a firing pulse to be provided to said semiconductor switch controller in the first half period after the occurrence of the arc, wherein said firing angle is determined from the latest stored measured peak voltage value and a residual voltage measured during said blocking period; and providing a firing pulse with the determined firing angle to said semiconductor switch controller. In this way, it is ensured that a blocking period is only inserted in case of arcing, thus allowing a much faster voltage recovery in case of sparks.

A high voltage power supply comprises a transformer-rectifier set comprising a high voltage transformer, a primary side of which is connectable to an AC industrial mains net having a line frequency, and a high voltage bridge rectifier connected to a secondary side of said high voltage transformer and configured to supply a rectified high voltage to said electrostatic precipitator; a semiconductor switch controller arranged at the primary side of said high voltage transformer and configured to control an output power level of the high voltage power supply; firing circuitry configured to provide firing pulses to said semiconductor switch controller; and a control unit configured to determine a firing angle of said firing pulses and to control said firing circuitry accordingly. The control unit comprises a breakdown detector configured to detect the occurrence of an electrical break-down in said electrostatic precipitator; an interface circuit configured to measure, during normal operation of said electrostatic precipitator, a peak voltage value over said electrostatic precipitator in each half period of said line frequency and to measure, when a breakdown is detected, a residual voltage over the electrostatic precipitator; a memory configured to store said measured peak voltage value; and a calculation unit configured to determine a firing angle of a firing pulse to be provided to said semiconductor switch controller in the first half period after the occurrence of a breakdown, wherein the calculation unit is further configured to determine said firing angle from the latest stored measured peak voltage value and the measured residual voltage based on a predetermined relationship between said firing angle and the latest stored measured peak voltage value and the measured residual voltage.

When the peak voltage just before a breakdown and the residual voltage just after the breakdown are measured, and a new firing angle is determined from these measured values and a predetermined relationship between them and an appropriate firing angle, an improved voltage recovery of the electrostatic precipitator can be achieved.

In some embodiments, the predetermined relationship with said firing angle and the latest stored measured peak voltage value and the measured residual voltage has been determined by computer simulations on a model of said electrostatic precipitator and said transformer-rectifier set. This allows a satisfactory determination of the relationship. Alternatively, the predetermined relationship may be determined based on measurements performed on the components of the power supply and the electrostatic precipitator.

The predetermined relationship may have been approximated by a set of linear functions, wherein each linear function defines an approximated relationship between an aimed peak voltage value and said firing angle for a value of measured residual voltage. Such approximation simplifies the determination of the desired firing angle.

The calculation unit may be configured to calculate said firing angle from the latest stored measured peak voltage value and the measured residual voltage using a mathematical expression representing each of said linear functions.

In such case, the calculation unit may be configured to calculate said firing angle on-line from the latest stored measured peak voltage value and the measured residual voltage using said mathematical expression when a breakdown has been detected.

Alternatively, the control unit may further comprise a look-up table having stored therein firing angle values pre-calculated for different values of the peak voltage before the breakdown and the residual voltage using said mathematical expression; and the calculation unit is configured to read, when a breakdown has been detected, a pre-calculated firing angle value corresponding to the latest stored measured peak voltage value and the measured residual voltage from said look-up table.

In some embodiments, the control unit is further configured to use under normal operation of said electrostatic precipitator a closed-loop control of a mean output current from the power supply to determine a value of the firing angle to be used in each half period of the line frequency; open, when a breakdown is detected, said closed-loop control via a switch; determine in the calculation unit a firing angle from the latest stored measured peak voltage value and the measured residual voltage; and provide via said switch a first firing pulse with the determined firing angle to said semiconductor switch controller. In this case, the control unit may further be configured to revert to the closed-loop control of the mean output current from the power supply to determine the value of the firing angle to be used in each half period of the line frequency when the semiconductor switch controller has been fired with said first firing pulse.

Alternatively, the control unit may further be configured to determine, when the semiconductor switch controller has been fired with said first firing pulse, a further firing angle from the latest stored measured peak voltage value and a residual voltage measured after said first firing pulse; provide a second firing pulse with the determined further firing angle to said semiconductor switch controller; and revert to the closed-loop control of the mean output current from the power supply to determine the value of the firing angle to be used in each half period of the line frequency when the semiconductor switch controller has been fired with said second firing pulse.

In some embodiments, the control unit may further be configured to determine by measuring an output voltage of the power supply whether the detected break-down is a spark or an arc; insert, if the detected breakdown is an arc, a blocking period of a few half-periods, where the semiconductor switch controller is not fired; determine after said blocking period a firing angle of a firing pulse to be provided to said semiconductor switch controller in the first half period after the occurrence of the arc, wherein said firing angle is determined from the latest stored measured peak voltage value and a residual voltage measured during said blocking period; and provide a firing pulse with the determined firing angle to said semiconductor switch controller. In this way, it is ensured that a blocking period is only inserted in case of arcing, thus allowing a much faster voltage recovery in case of sparks.

In some embodiments, the semiconductor switch controller is a thyristor controller comprising a set of antiparallel coupled thyristors.

An electrostatic precipitator apparatus may comprise an electrostatic precipitator and a high voltage power supply as described above.

Although various embodiments of the present invention have been described and shown, the invention is not restricted thereto, but may also be embodied in other ways within the scope of the subject-matter defined in the following claims.

The invention claimed is:

1. A method of controlling a high voltage power supply for an electrostatic precipitator, said high voltage power supply comprising:

a transformer-rectifier set comprising a high voltage transformer, a primary side of which is connectable to an AC industrial mains net having a line frequency, and a high voltage bridge rectifier connected to a secondary side of said high voltage transformer and configured to supply a rectified high voltage to said electrostatic precipitator;

a semiconductor switch controller arranged at the primary side of said high voltage transformer and configured to control an output power level of the high voltage power supply;

firing circuitry configured to provide firing pulses to said semiconductor switch controller; and a control unit configured to determine a firing angle of said firing pulses and to control said firing circuitry accordingly, wherein the method comprises the steps of:

measuring during normal operation of said electrostatic precipitator a peak voltage value over said electrostatic precipitator in each half period of said line frequency;

storing said measured peak voltage value;

detecting the occurrence of an electrical breakdown in said electrostatic precipitator;

measuring, when a breakdown is detected, a residual voltage over the electrostatic precipitator;

determining a firing angle of a firing pulse to be provided to said semiconductor switch controller in the first half period after the occurrence of said breakdown, wherein said firing angle is determined from the latest stored measured peak voltage value and the measured residual voltage based on a predetermined relationship with said firing angle and the latest stored measured peak voltage value and the measured residual voltage; and providing a firing pulse with the determined firing angle to said semiconductor switch controller.

2. A method according to claim 1, wherein the method further comprises the step of determining said predetermined relationship with said firing angle and the latest stored measured peak voltage value and the measured residual voltage by performing computer simulations on a model of said electrostatic precipitator and said transformer-rectifier set.

3. A method according to claim 1, wherein the method further comprises the step of approximating said predetermined relationship by a set of linear functions, wherein each linear function defines an approximated relationship between an aimed peak voltage value and said firing angle for a value of measured residual voltage.

4. A method according to claim 3, wherein the method further comprises the step of providing a mathematical expression representing each of said linear functions, so that said firing angle can be calculated from the latest stored measured peak voltage value and the measured residual voltage using said mathematical expression.

5. A method according to claim 4, wherein the method further comprises the step of calculating said firing angle on-line from the latest stored measured peak voltage value and the measured residual voltage using said mathematical expression when a breakdown has been detected.

6. A method according to claim 4, wherein the method further comprises the steps of:

pre-calculating said firing angle for different values of the peak voltage before the breakdown and the residual voltage using said mathematical expression;

storing the pre-calculated firing angle values together with corresponding values of the peak voltage before the breakdown and the residual voltage in a look-up table; and reading, when a breakdown has been detected, a pre-calculated firing angle value corresponding to the latest stored measured peak voltage value and the measured residual voltage from said look-up table.

7. A method according to claim 1, wherein the method further comprises the steps of:

using under normal operation of said electrostatic precipitator a closed-loop control of a mean output current from the power supply to determine a value of the firing angle to be used in each half period of the line frequency;

opening, when a breakdown is detected, said closed-loop control;

determining a firing angle from the latest stored measured peak voltage value and the measured residual voltage; and providing a first firing pulse with the determined firing angle to said semiconductor switch controller.

8. A method according to claim 7, wherein the method further comprises the step of:

reverting to the closed-loop control of the mean output current from the power supply to determine the value of the firing angle to be used in each half period of the line frequency when the semiconductor switch controller has been fired with said first firing pulse.

9. A method according to claim 7, wherein the method further comprises the steps of:

determining, when the semiconductor switch controller has been fired with said first firing pulse, a further firing angle from the latest stored measured peak voltage value and a residual voltage measured after said first firing pulse;

providing a second firing pulse with the determined further firing angle to said semiconductor switch controller; and reverting to the closed-loop control of the mean output current from the power supply to determine the value of the firing angle to be used in each half period of the line frequency when the semiconductor switch controller has been fired with said second firing pulse.

10. A method according to any one of claim 1, wherein the method further comprises the steps of:

determining by measuring an output voltage of the power supply whether the detected breakdown is a spark or an arc;

inserting, if the detected breakdown is an arc, a blocking period of a few half-periods, where the semiconductor switch controller is not fired;

determining after said blocking period a firing angle of a firing pulse to be provided to said semiconductor switch controller in the first half period after the occurrence of the arc, wherein said tiring angle is determined from the latest stored measured peak voltage value and a residual voltage measured during said blocking period; and providing a firing pulse with the determined firing angle to said semiconductor switch controller.

11. A high voltage power supply for an electrostatic precipitator, said high voltage power supply comprising:

a transformer-rectifier set comprising a high voltage transformer, a primary side of which is connectable to an AC industrial mains net having a line frequency, and a high voltage bridge rectifier connected to a secondary side of said high voltage transformer and configured to supply a rectified high voltage to said electrostatic precipitator;

a semiconductor switch controller arranged at the primary side of said high voltage transformer and configured to control an output power level of the high voltage power supply;

firing circuitry configured to provide firing pulses to said semiconductor switch controller; and a control unit configured to determine a firing angle of said firing pulses and to control said firing circuitry accordingly, wherein the control unit comprises:

a breakdown detector configured to detect the occurrence of an electrical breakdown in said electrostatic precipitator;

an interface circuit configured to measure, during normal operation of said electrostatic precipitator, a peak voltage value over said electrostatic precipitator in each half period of said line frequency and to measure, when a breakdown is detected, a residual voltage over the electrostatic precipitator;

a memory configured to store said measured peak voltage value; and a calculation unit configured to determine a firing angle of a firing pulse to be provided to said semiconductor switch controller in the first half period after the occurrence of a breakdown, wherein the calculation unit is further configured to determine said firing angle from the latest stored measured peak voltage value and the measured residual voltage based on a predetermined relationship with said firing angle and the latest stored measured peak voltage value and the measured residual voltage.

12. A high voltage power supply according to claim 11, wherein said predetermined relationship with said firing angle and the latest stored measured peak voltage value and the measured residual voltage has been determined by computer simulations on a model of said electrostatic precipitator and said transformer-rectifier set.

13. A high voltage power supply according to claim 11, wherein said predetermined relationship has been approximated by a set of linear functions, wherein each linear function defines an approximated relationship between an aimed peak voltage value and said firing angle for a value of measured residual voltage.

14. A high voltage power supply according to claim 13, wherein the calculation unit is configured to calculate said firing angle from the latest stored measured peak voltage value and the measured residual voltage using a mathematical expression representing each of said linear functions.

15. An electrostatic precipitator apparatus comprising an electrostatic precipitator and a high voltage power supply according to claim 11.

* * * * *